US006196872B1

(12) United States Patent
Murakami et al.

(10) Patent No.: US 6,196,872 B1
(45) **Date of Patent: *Mar. 6, 2001**

(54) WATERPROOF CONNECTOR AND METHOD ASSEMBLING OF THE SAME

(75) Inventors: Takao Murakami; Masaru Fukuda, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/327,548

(22) Filed: Jun. 8, 1999

(30) Foreign Application Priority Data

Jun. 10, 1998 (JP) ..... 10-162521

(51) Int. Cl.[7] ..... H01R 13/40
(52) U.S. Cl. ..... 439/587
(58) Field of Search ..... 439/589, 588, 439/598, 274, 275, 586, 597, 587, 190, 271

(56) References Cited

U.S. PATENT DOCUMENTS

| | | | | |
|---|---|---|---|---|
| 4,713,021 | * | 12/1987 | Kobler | 439/272 |
| 5,116,236 | | 5/1992 | Colleran et al. | 439/271 |
| 5,197,898 | | 3/1993 | Nagamine | 439/271 |
| 5,197,899 | * | 3/1993 | Akeda | 439/271 |
| 5,634,807 | | 6/1997 | Saito | 439/275 |
| 5,645,451 | | 7/1997 | Ohsumi et al. | 439/587 |

FOREIGN PATENT DOCUMENTS

| | | | |
|---|---|---|---|
| 19641408 | 4/1997 | (DE) | H01R/13/52 |
| 07130425 | 5/1995 | (JP) | H01R/13/52 |
| WO 9632760 | 10/1996 | (WO) . | |
| WO 9736346 | 10/1997 | (WO) . | |

OTHER PUBLICATIONS

European Search Report dated Dec. 10, 1999.

* cited by examiner

*Primary Examiner*—Neil Abrams
*Assistant Examiner*—Michael C. Zarroli
(74) *Attorney, Agent, or Firm*—Finnegan, Henderson, Farabow, Garrett & Dunner, L.L.P.

(57) ABSTRACT

The present invention provides the steps of passing an electric wire through a first housing, an elastic plug and a spacer; fitting a spacer in the first housing so as to align the elastic plug with a plug accommodation portion of the first housing; connecting an electric wire while the terminal is in a second housing; fitting the second housing inside the spacer; and fitting the spacer inside the first housing to press the elastic plug into the plug accommodation portion of the first housing.

10 Claims, 11 Drawing Sheets

WATERPROOF CONNECTOR AND METHOD ASSEMBLING OF THE SAME

BACKGROUND OF THE INVENTION

1. Field of the Invention

The present invention relates to a small-sized and multipolor waterproof connector that enhances waterproofing between a connector housing and plural electric wires connected with terminals and an assembling method of the same.

2. Description of Relevant Art

In a kind of a waterproof connector and an assembling method of the same, the housing of the waterproof connector is composed of a synthetic resin-made inner housing which is integrally formed with a plurality of terminal accommodation chambers, a synthetic resin-made outer housing in which the inner housing is fitted, a synthetic resin spacer which is interposed between the inner housing so as to the outer housing and keeps female terminals accommodated in each terminal accommodation chamber. The outer housing has a rubber plug accommodation portion for receiving a rubber plug accommodated therein. An electric wire passes through each through hole of the outer housing, rubber plug and spacer and is connected with a terminal of the inner housing.

However, in typical waterproof connectors, when the inner housing is fitted in a side of the outer housing, the rubber plug is accommodated in the rubber plug accommodation portion. Thus, when the inner housing is fitted inside the spacer, which that has been fitted in the inside of the outer housing, while the electric wires are slide through each hole of the spacer and the outer housing, the rubber plug presses upon the electric wire and the electric wire is likely to buckle by friction force to be generated between the rubber plug and the electric wire. As a result, the efficiency of the assembling operation of the waterproof connector is decreased.

SUMMARY OF THE INVENTION

An exemplary object of the invention is to provide a miltipolar waterproof connector that enhances efficiency of assembling work and an assembling method of the same.

In accordance with a first aspect of the present invention, there is provided an assembling method of a waterproof connector having terminals connected to electric wires accommodated in a connector housing and so as to be sealed by an elastic plug. The method comprises the steps of: passing an electric wire through a first housing, an elastic plug and a spacer; fitting the spacer inside the first housing so as to align the elastic plug with the plug accommodation portion of the first housing connecting the electric wire while the terminal is in the second housing; fitting a second housing inside the spacer; and fitting the spacer inside the first housing to press the an elastic plug into the plug accommodation portion of the first housing.

In accordance with a second exemplary aspect of the present invention, there is provided a waterproof connector having terminals connected to electric wires accommodated in a connector housing so as to be sealed by an elastic plug. The waterproof connector comprises: an electric wire which is connected with a terminal; a first housing having a plug accommodation portion and configured for receiving the electric wire passed theretrough; a spacer fitted inside the first housing configured for receiving the electric wire passed therethrough; a second housing fitted inside the spacer and configured for receiving the terminal and receiving the electric wire being passed therethrough; an elastic plug which is accommodated in the plug accommodation portion, and is configured for receiving the electric wire being passed therethough; and a positioning means arranged between the first housing and the spacer so as to align the elastic plug to be aligned with the plug accommodation portion of the first fusing, before the elastic plug is accommodated inside the plug accommodation portion.

Preferably, the positioning means comprise a first taper portion provided on an opening side of the plug accommodation portion of the first housing.

Alternately, the positioning means comprises a second taper portion which is provided on the spacer, so as to oppose the plug accommodation portion of the first housing;

The positioning may also comprise an engagement member configured for engaging the elastic plug while being slid into the first housing.

From a third exemplary aspect of the present invention, there is provided a waterproof connector having terminals connected to electric wires accommodated in a connector housing so as to be sealed by an elastic plug. The waterproof connector comprises: an electric wire connected with a terminal; a first housing having a plug accommodation portion and configured for receiving the electric wire being passed therethrough; a spacer fitted in the first housing configured for receiving the electric wire being passed therethrough; a second housing fitted in the spacer and configured for accommodating the terminal, and receiving the electric wire being passed therethrough; and an elastic plug which is selectively accommodated in the plug accommodation portion and is configured for receiving the electric wire being passed therethrough. A first taper portion is formed on an opening side of the plug accommodation portion of the first housing. A second taper portion is formed on the spacer and is opposed to the plug accommodation portion. The elastic plug is interposed between the first taper portion and the second taper portion before the elastic plug is accommodated in or pressed into the plug accommodation portion.

Preferably, the elastic plug has an inside diameter equal to or greater than a diameter of the electric wire and the elastic plug has an outside diameter greater than a diameter of the plug accommodation portion.

In the assembling method of the waterproof connector, when the second housing, or inner housing, is fitted in the spacer in a provisionally by-engagement kept state where it has been fitted in an inside of the first housing, or outer housing, with the elastic plug interposed therebetween, while the electric wire is being slid to each insertion through hole of the spacer and the first housing, the elastic plug is not subjected to pressure force of the elastic plug. Thus, the electric wire is smoothly assembled without buckling, and the multipolar connector which has an excellent waterproofness is easily assembled over a short period of time, so that the efficiency of the entire assembling operation is further enhanced.

In the waterproof connector, when the second housing is fitted inside the spacer that has been fitted in an inside of the first housing, while the electric wire is being slid to each electric wire insertion through hole of the spacer and the first housing, there becomes a provisionally by-engagement kept state where the elastic plug is interposed between the first taper portion of the plug accommodation portion and the second taper portion near each electric wire insertion through hole of the spacer. The electric wire is slid to each electric wire insertion through hole of the spacer and the first housing before the elastic plug is accommodated in the plug accommodation portion. Thus, the electric wire is prevented from being buckled by pressure force of the elastic plug, and the efficiency of the assembling operation is enhanced. Further, the elastic plug is smoothly and securely accommodated in the plug accommodation portion by the second taper portion of the spacer, and seal efficiency is enhanced.

In the waterproof connector, the inside diameter of the elastic plug is greater than a diameter of the electric wire and the elastic plug does not press the electric wire. Thus, when the second housing is fitted in the spacer that has been fitted in an inside of the first housing in a provisionally by-engagement kept state, the electric wire is smoothly slid to each electric wire insertion through hole of the spacer and the first housing without being buckled. As a result, the waterproof connector is easily assembled, and the efficiency of the assembling operation is further enhanced. Further, the outside diameter of the elastic plug is greater than a diameter of the plug accommodation portion, and reliability of waterproofness by the elastic plug is enhanced.

In the waterproof connector, the elastic plug selectively engages the engagement member which is provided on a wall portion side of the spacer. Thus, when the spacer is in a by-engagement kept state where it is fitted in the inside of the first housing with the elastic plug being interposed therebetween the spacer is entirely fitted inside the first housing so as to move to a regularly by-engagement kept state, thus elastic plug is easily and reliably accommodated in the plug accommodation portion. Further, when the spacer is returned from the regularly engagement kept state to the by-engagement kept state in the inside of the first housing, it is easily reliably detached from the plug accommodation portion

BRIEF DESCRIPTION OF THE ACCOMPANYING DRAWINGS

DETAILED DESCRIPTION OF THE PREFERRED EMBODIMENTS

Embodiments of the present invention will now be explained with reference to the drawings.

FIRST EMBODIMENT

Figure 1:
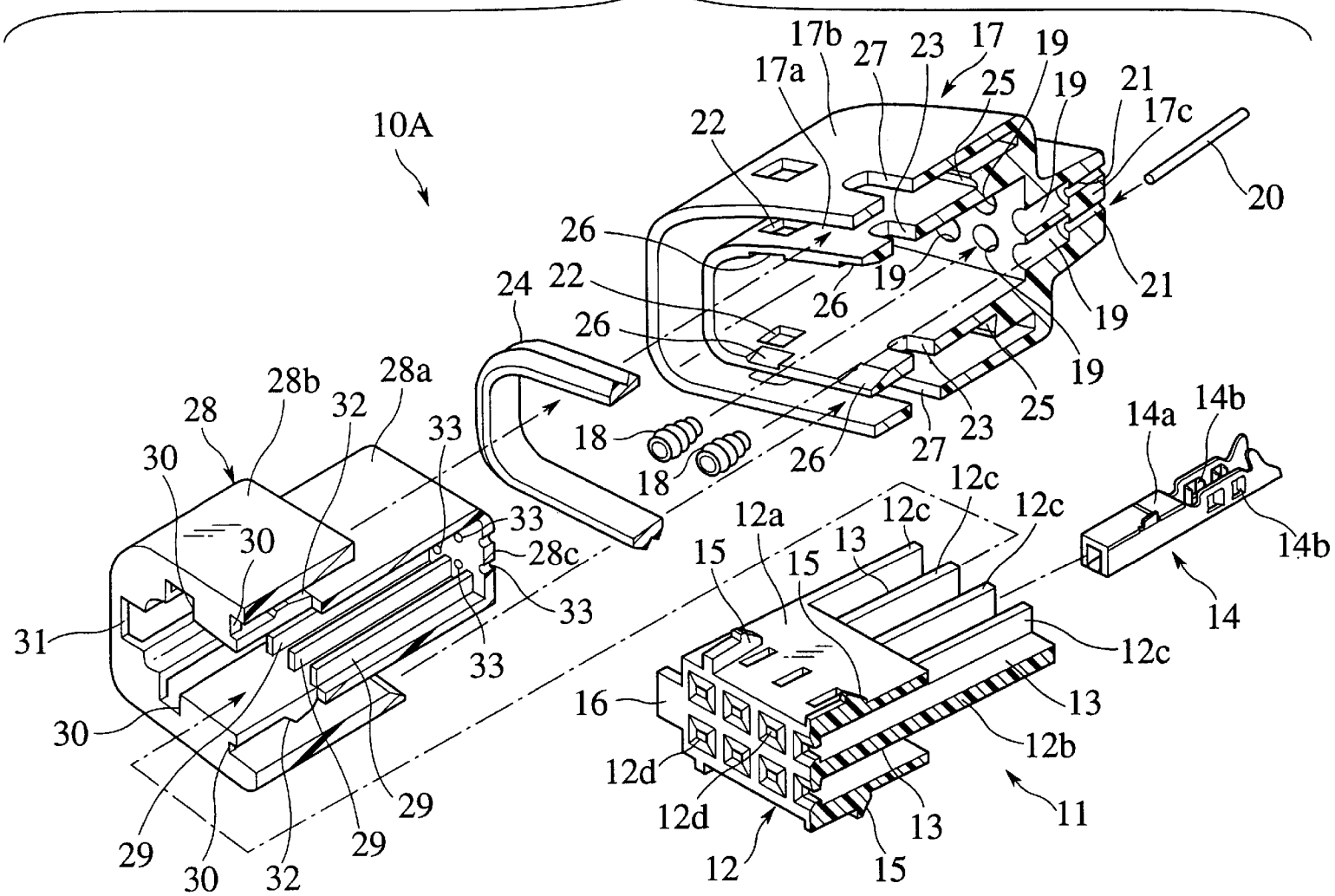
FIG. 1 is a perspective view illustrating, partly in section, a state prior to the assembling of a waterproof connector according to a first embodiment of the present invention.
Figure 2:
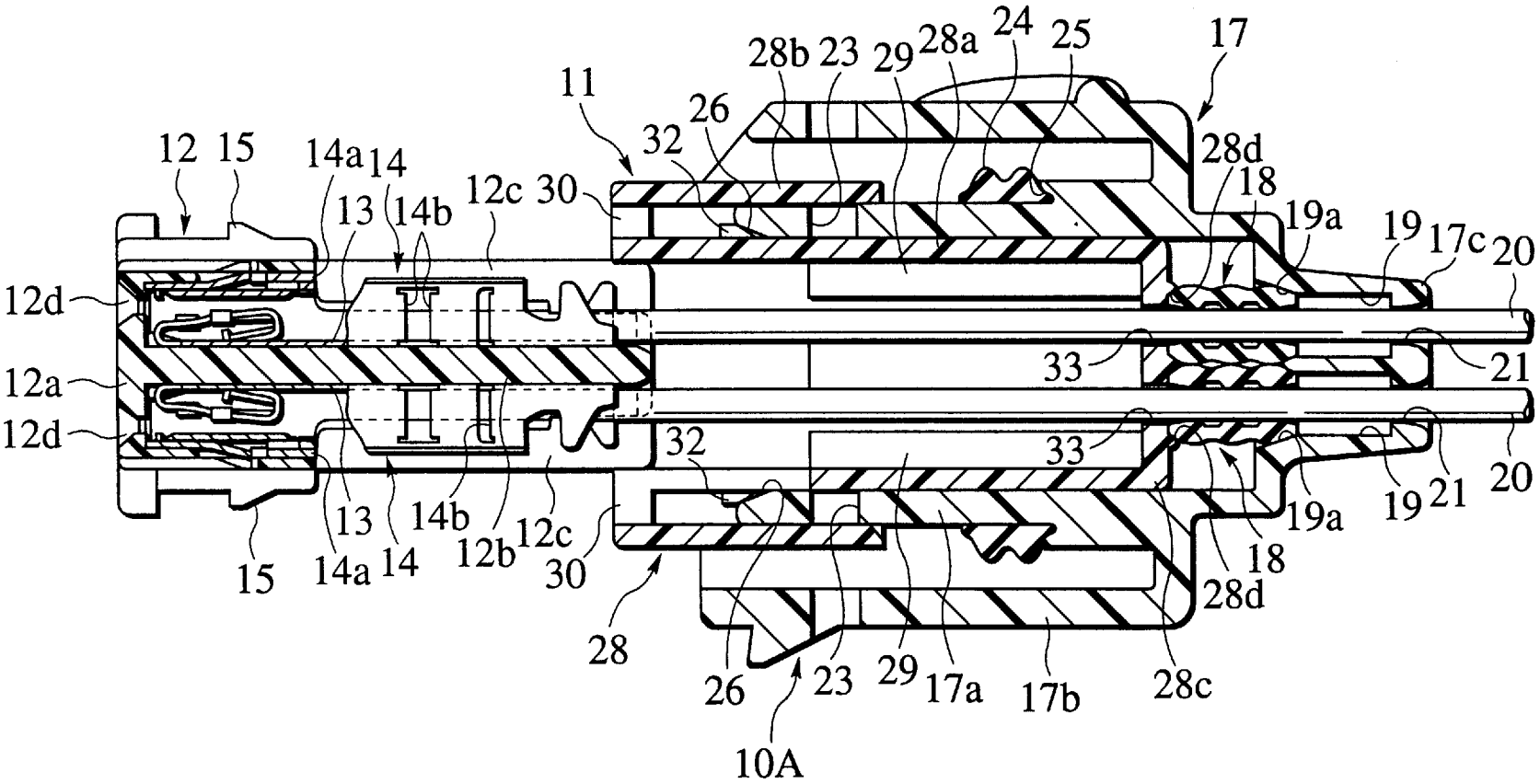
FIG. 2 is a sectional view illustrating a provisionally by-engagement kept state of an outer housing and spacer of the waterproof connector illustrated in FIG. 1.

As illustrated in FIGS. 1 and 2, a connector housing 11 of a waterproof connector 10A is constructed of a synthetic resin-made inner housing 12 having integrally formed therein a plurality of terminal accommodation chambers 13, a synthetic resin-made outer housing 17 having the inner housing 12 fitted thereinto, and a synthetic resin-made spacer 28 interposed between the inner housing 12 and outer housing 17 and fixing female terminals (terminals) 14 that have been accommodated in their respective terminal accommodation chambers 13 of the inner housing 12.

The inner housing 12 has a box portion 12*a* the upper and lower surfaces of which are open on their rear sides. The respective terminal accommodation chambers 13 are formed within spaces that are formed between a central horizontal wall 12*b* and upper and lower vertical side walls 12*c* concurrently serving as partitioning walls. The female terminals 14 are accommodated within their respective terminal accommodation chambers 13. Also, engaging pawls (separate engaging portions) 15 are integrally projectively formed on both sides and center of each of upper and lower surfaces of the box portion 12*a*. Flange portions 16 are integrally projectively formed on frontal ends at the centers of both sides of the box portion 12*a*. It is to be noted that at the positions of front walls of the box portion 12*a* which oppose the respective terminal accommodation chambers 13 there are formed rectangular insertion through holes 12*d* for permitting the insertion therethrough of male terminals of a mated side connector not illustrated. In each of both side plate portions at a rear part of the box portion 14*a* of the female terminal 14 there are formed a pair of pressure-contact blades 14*b* by the side plate portion being bent.

The outer housing 17 is constituted by a substantially square-cylindrical inner wall portion 17*a*, a substantially square-cylindrical outer wall portion 17*b* that encloses the inner wall portion 17*a*, and a bottom wall portion (a wall portion) 17*c* that connects together rear portions of the inner and outer wall portions 17*a*, 17*b*. The outer housing 17 is thereby made into a double-walled box whose frontal surface sides are open. The bottom wall portion 17*c* is thick-walled at the center. At the positions on a front side of the thick-walled portion which oppose their respective terminal accommodation chambers 13 there are respectively formed large-in-diameter and circular-in-section rubber plug accommodation recesses 19, or plug accommodation portion, into which waterproof rubber plugs 18, or elastic plugs, are accommodated by forced insertion or the like. On a rear side of the thick-walled portion there are respectively formed small-in-diameter and circular-in-section electric wire insertion through holes 21 for permitting the insertion therethrough of electric wires 20 in such a way that these insertion through holes communicate with their corresponding rubber plug accommodation recesses 19. The waterproof rubber plugs 18 are each in the form of a substantially circular-cylindrical member the inner-and outer-peripheral surfaces of which are each in the form of concavities and convexities. It is arranged that the electric wires 20 are passed internally therethrough with no clearances remaining to exist.

Also, on both front sides of upper and lower walls of the inner wall portion 17*a* of the outer housing 17 there are respectively formed rectangular engaging holes (engaging portions) 22 with or from which the respective engaging pawls 15 located on both sides of the upper and lower surfaces of the box portion 12*a* of the inner housing 12 are engaged or disengaged. At front side centers of the upper and lower walls of the inner wall portion 17*a* there are respectively formed rectangular elongate engaging holes (engaging portions) 23 with or from which the respective engaging pawls 15 at the centers of the upper and lower surfaces of the box portion 12*a* of the inner housing 12 are engaged or disengaged. Further, at a large-depth portion on the outer surface side of the inner wall portion 17*a* of the outer housing 17 there is integrally projectively formed a V-shaped packing receiver 25 for receiving therein an annular and rubber-made waterproof packing 24. It is to be noted that at the positions, opposing the respective engaging holes 22, 23, of front edges on the inner surface sides of the inner wall portion 17*a* of the outer housing 17 there are respectively formed taper faces 26. Also, on front sides of upper and lower walls of the outer wall portion 17*b* of the outer housing 17 there are respectively formed engaging holes (engaging portions) 27 with or from which flexible engaging arms of a mated side connector not illustrated are engaged or disengaged.

The spacer 28 is constituted by a substantially square-cylindrical trunk portion 28*a* that is fitted into an inner surface side of the inner wall portion 17*a* of the outer housing 17, a substantially square-cylindrical collar portion 28*b* that is integrally formed in such a way as to be bent rearward from a front end of the trunk portion 28*a* and that is fitted onto an outer surface side of the inner wall portion 17*a* of the outer housing 17, and a bottom wall portion (a wall portion) 28*c* of the trunk portion 28*a*. The spacer 28 is thereby made into a box whose front surface side is open.

It is arranged that the box portion 12*a* of the inner housing 12 is fitted into the interior of the trunk portion 28*a* of the spacer 28. On inner surfaces of the upper and lower walls of the trunk portion 28*a* of the spacer 28 there are integrally formed, respectively, rib-like and terminal fall-off preventing projections 29 that keep, by engagement, a rear end edge of the box portion 12*a* of the inner housing 12 and rear end edges of the box portions 14*a* of the female terminals 14.

Also, at the positions, opposing the respective engaging pawls 15 and flange portions 16 of the inner housing 12, on a front side of a portion of connection between the trunk portion 28*a* and collar portion 28*b* of the spacer 28 there are respectively formed notched portions 30, 31. On outer surface sides of the upper and lower walls of the trunk portion 28*a* of the spacer 28 between the notched portions 30 on the upper and lower sides there are integrally projectively formed engaging pawls (other engaging portions) 32 that are engaged with or disengaged from their corresponding engaging holes 23 of the outer housing 17. Further, a forward end portion of the collar portion 28*b* of the spacer 28 is arranged to keeping, when the fitting thereof into the outer housing 17, the packing 24 in engagement with the packing receiver 25 of the inner wall portion 17*a* of the outer housing 17.

Figure 5:
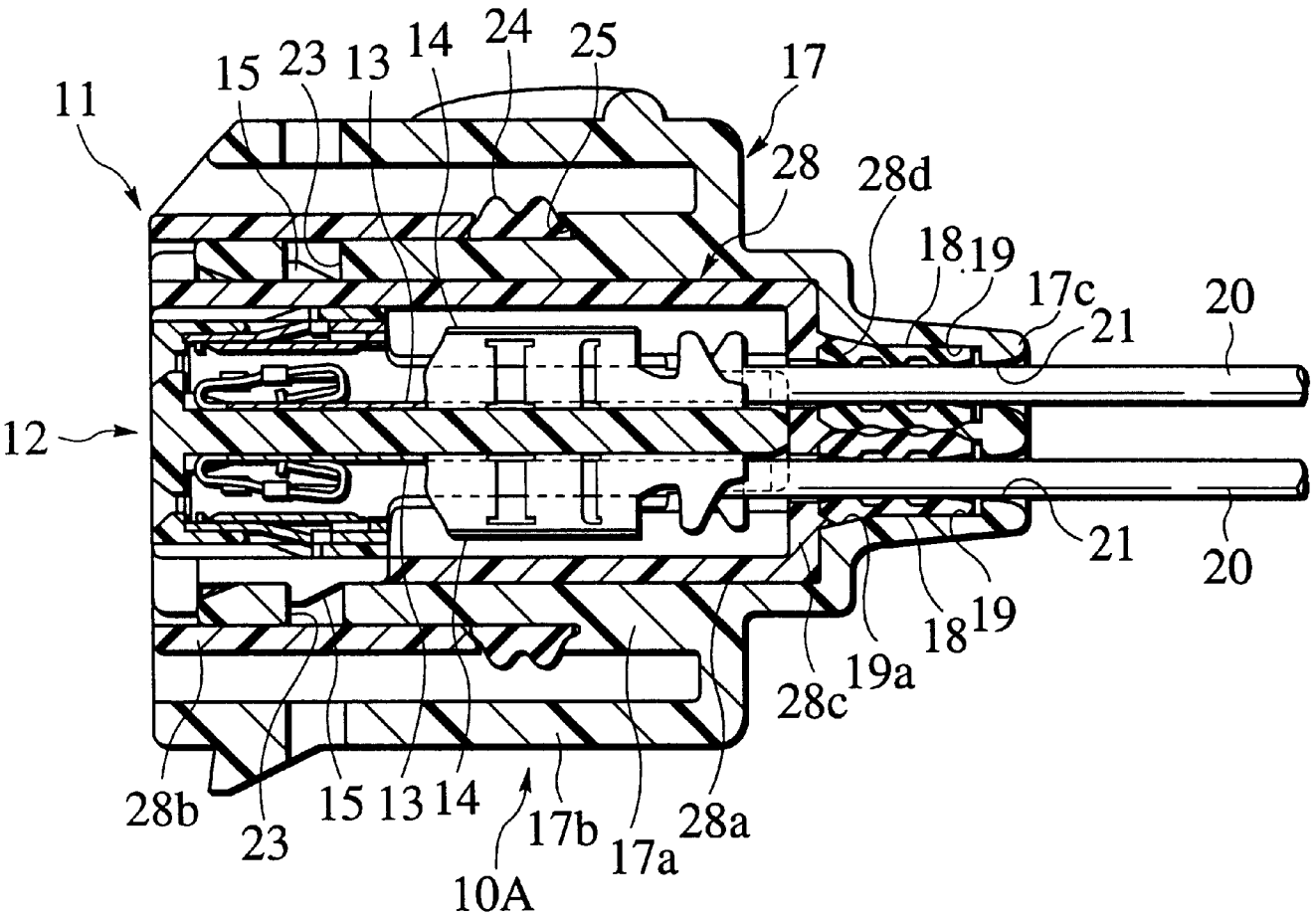
FIG. 5 is a sectional view illustrating a regularly by-engagement kept state where the spacer has been by-engagement kept by an outer housing of the waterproof connector.

Also, at the positions of the bottom wall portion 28*c* of the spacer 28 which oppose the respective electric wire insertion through holes 21 of the outer housing 17, there are respectively formed electric wire insertion through holes 33. Also, it is arranged that the bottom wall portion 28*c* of the spacer 28 keeps the rubber plugs. 18 which when the fitting thereof into the outer housing 17 has been completed have been inserted into their corresponding rubber plug accommodation recesses 19 of the bottom wall portion 17*c* of the outer housing 17. As illustrated in FIG. 5, the electric wires 20 that have been passed through their corresponding electric wire insertion through holes 21 of the outer housing 17 and their corresponding electric wire insertion through holes 33 of the rubber plugs 18 and spacer 28 are each connected, by pressure contact, between a corresponding pair of pressure contact blades 14*b*, 14*b* of a corresponding one of the female terminals 14 accommodated in the respective terminal accommodation chambers 13 of the inner housing 12. Whereby, the respective terminal accommodation chambers 13 and electric wires 20 are respectively sealed by the respective rubber plugs 18 and packing 24. In the step, the term "pressure contact" means that an insulator of the electric wire 20 is displaced by the blades 14*b* and a conductor of the electric wire is contacted with the blades 14*b*.

Here, as illustrated in FIG. 2, an inverse-conical surface (taper face) 19*a*, or a first taper portion (e.g., alternatively referred as a front tapered portion), is formed on an opening side of each of the respective rubber plug accommodation recesses 19 located inside the bottom wall portion (a wall portion) 17*c* of the outer housing 17. Also, an inverse-conical surface (taper face) 28*d*, or a second taper portion (e.g., alternatively referred as a rear tapered portion), concurrently serving as a rubber plug pressing portion is formed around each of the respective electric wire insertion through holes 33 on an outer side of the bottom wall portion (a wall portion) 28*c* of the spacer 28. Before accommodating the rubber plugs 18 in their corresponding rubber plug accommodation recesses 19 of the outer housing 17 (when the spacer 28 is in its provisionally kept state illustrated in FIG. 2 wherein the front side of the trunk portion 28*a* of the spacer 28 has been fitted into the inner wall portion 17*a* of the outer housing 17), the rubber plug 18 is to be interposed between the inverse-conical surface 19*a* of the rubber plug accommodation recess 19 and the inverse-conical surface 28*d* around the corresponding electric wire insertion through hole 33 of the spacer 28.

Figure 3:
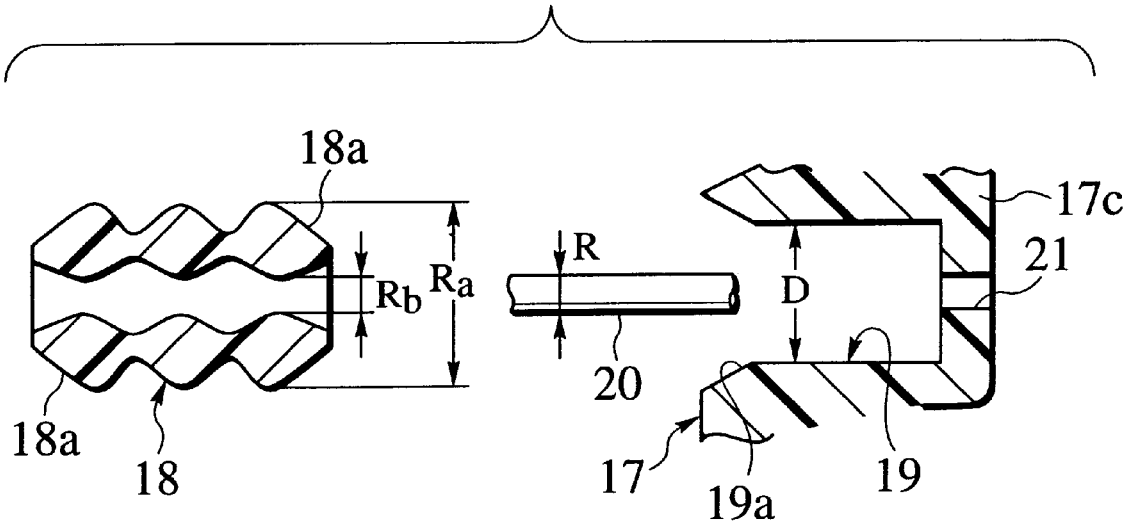
FIG. 3 is an enlarged explanatory view illustrating a main part of the waterproof connector illustrated in FIG. 1.

Also, as illustrated in FIG. 3, on both end sides (e.g., alternatively referred to front and rear end sides ) of the rubber plug 18 having the electric wire 20 passed therethrough there are respectively formed conical surfaces (taper faces) 18*a*. The inside diameter Rb of the rubber plug 18 (i.e., the diameter of the electric wire insertion through hole of the rubber plug 18) is so set as to be equal to or greater than the diameter R of the electric wire 20 ($Rb \geqq R$). Further, the outside diameter Ra of the rubber plug 18 is so formed as to become greater than the diameter D of the rubber plug accommodation recess 19. Namely, it is set that the sealing relationship ($Ra-Rb+R>D$) holds true within the rubber plug accommodation recess 19.

A method of assembling the waterproof connector 10A according to the above-described embodiment will now be explained.

First, the packing 24 is previously inserted into, and set in, the packing receiver 25 of the inner wall portion 17*a* of the outer housing 17 forming the outer side of the connector housing 11. The electric wires 20 are passed, from the outside, through a plurality of the electric wire insertion through holes 21 of the bottom wall portion 17*c* of the outer housing 17. Next, after having passed the rubber plugs 18 onto the electric wires 20, the electric wires 20 are passed from the outside through their corresponding electric wire insertion through holes 33 of the bottom wall portion 28*c* of the spacer 28.

Next, as illustrated in FIG. 2, the front side of the trunk portion 28*a* of the spacer 28 is fitted into the inner wall portion 17*a* of the outer housing 17, and the respective rubber plugs 18 are interposed between the inverse-conical surfaces 19*a* of the respective rubber plug accommodation portions 19 and the inverse-conical surfaces 28*d* formed at the inner-peripheral surfaces of the respective electric wire insertion through holes 33 of the bottom wall portion 28*c* of the spacer 28. Thus, the rubber plugs 18 are thereby previously provisionally kept therebetween. In this case, the rubber plugs 18 are not accommodated into their corresponding rubber plug accommodation recesses 19 inside the bottom wall portion 17*c* of the outer housing 17. At this time, since the rubber plug 18 is kept in a position by and between the inverse-conical surface 19*a* and the inverse-conical surface 28*d*, the rubber plug 18 is aligned with the rubber plug accommodation chambers 19 in a longitudinal direction of the electric wire 20. As a result of this, the rubber plugs 18 are prevented from being positionally displaced and are smoothly guided into their corresponding rubber plug accommodation chambers 19 without being incompletely accommodated therein.

Subsequently, each electric wire 20 is pressure contacted between a pair of pressure contact blades 14*b* of a corresponding one of the terminals 14 accommodated in a plurality of the terminal accommodation chambers 13 of the inner housing 12 that forms the inner side of the connector housing 11.

Figure 4:
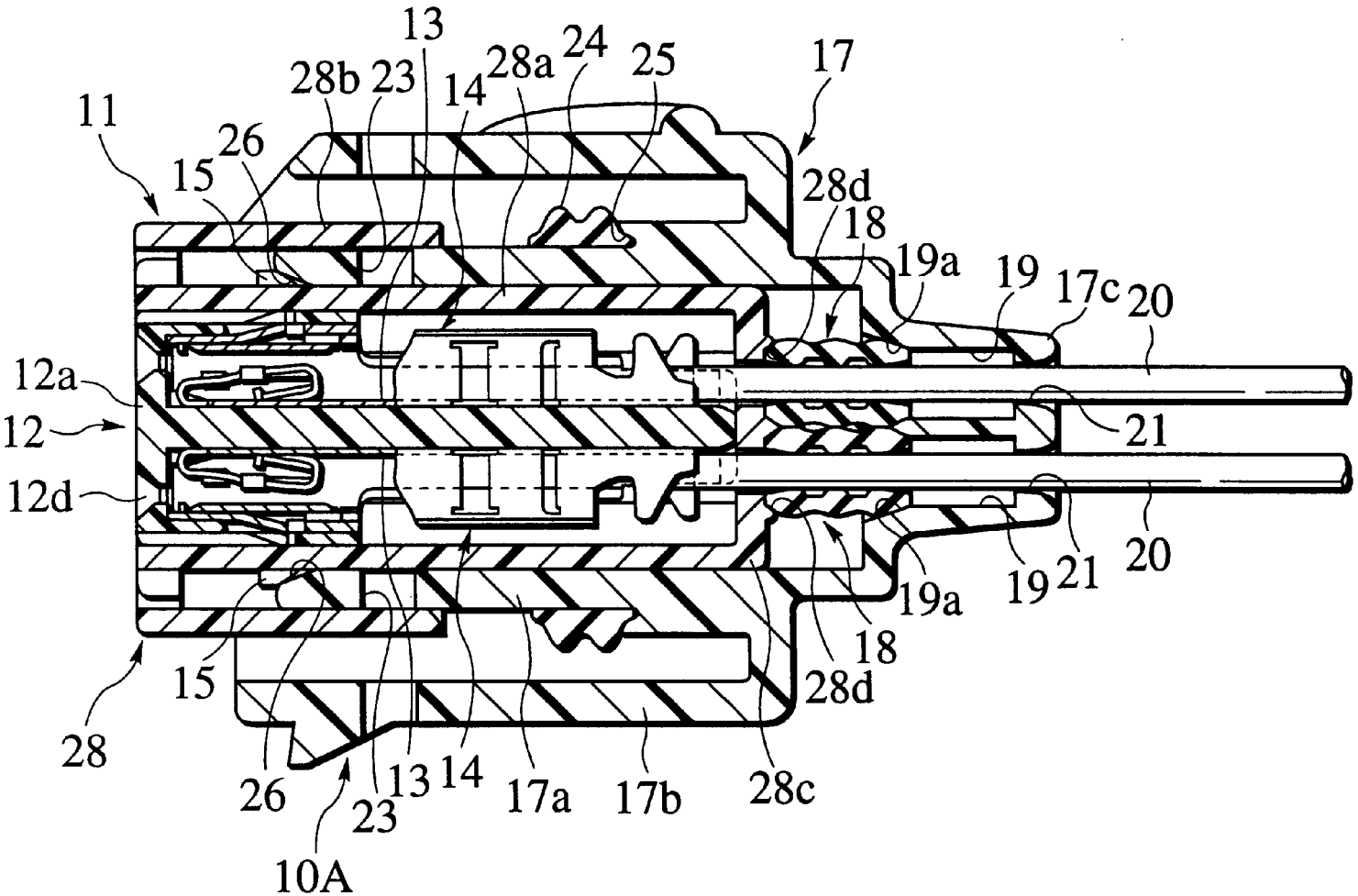
FIG. 4 is a sectional view illustrating a state where an inner housing illustrated in FIG. 2 has been fitted into a spacer.

Next, as illustrated in FIG. 4, while sliding the electric wires 20 with respect to the electric wire insertion through holes 33, 21 of the bottom wall portion 28*c* of the spacer 28 and bottom wall portion 17*c* of the outer housing 17, the inner housing 12 is fitted into the interior of the trunk portion 28*a* of the spacer 28.

At this time, since the electric wires 20 receive no pressing force of the rubber plugs 18, the electric wires 20 are smoothly assembled without being buckled. Also, since the positions of the rubber plugs 18 are kept as are, nor are the electric wires 20 bent or broken.

Further, as illustrated in FIG. 5, the trunk portion 28*a* of the spacer 28 is completely fitted into the inner wall portion 17*a* of the outer housing 17 and thereby regularly kept. At this time, because of the inverse-conical surfaces 28*d* formed at the frontal inner-peripheral surfaces of the respective electric wire insertion through holes 33 of the bottom wall portion 28*c* of the spacer 28, the rubber plugs 18 are press accommodated into their corresponding rubber plug accommodation recesses 19 jointly with the electric wires 20. As a result of this, the assembling of the waterproof connector 10A wherein the respective electric wires 20 are sealed by their corresponding rubber plugs 18 is completed.

In this way, when fitting the inner housing 12 into the spacer 28 that has been fitted in the outer housing 17 via the rubber plugs 18 and thereby provisionally kept, there is no possibility that the electric wires 20 will receive the pressing forces of the rubber plugs 18. Therefore, the inner housing 12 can be smoothly assembled with no electric wires 20 being buckled, with the result that the efficiency of the entire assembling operation is enhanced again.

SECOND EMBODIMENT

Figure 6:
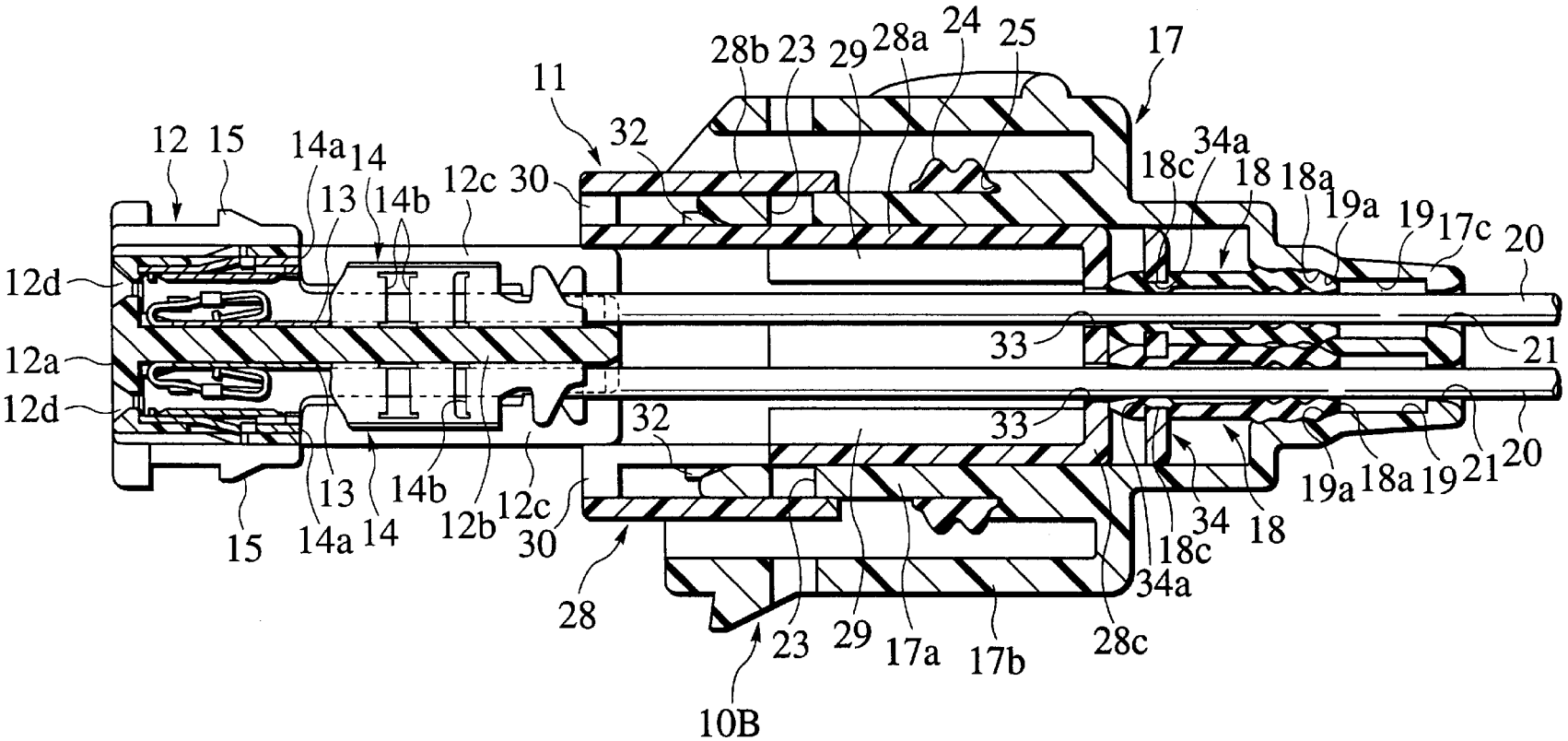
FIG. 6 is a sectional view illustrating a provisionally by-engagement kept state where a spacer has been by-engagement kept by an outer housing of a waterproof connector according to a second embodiment of the present invention.
Figure 7:
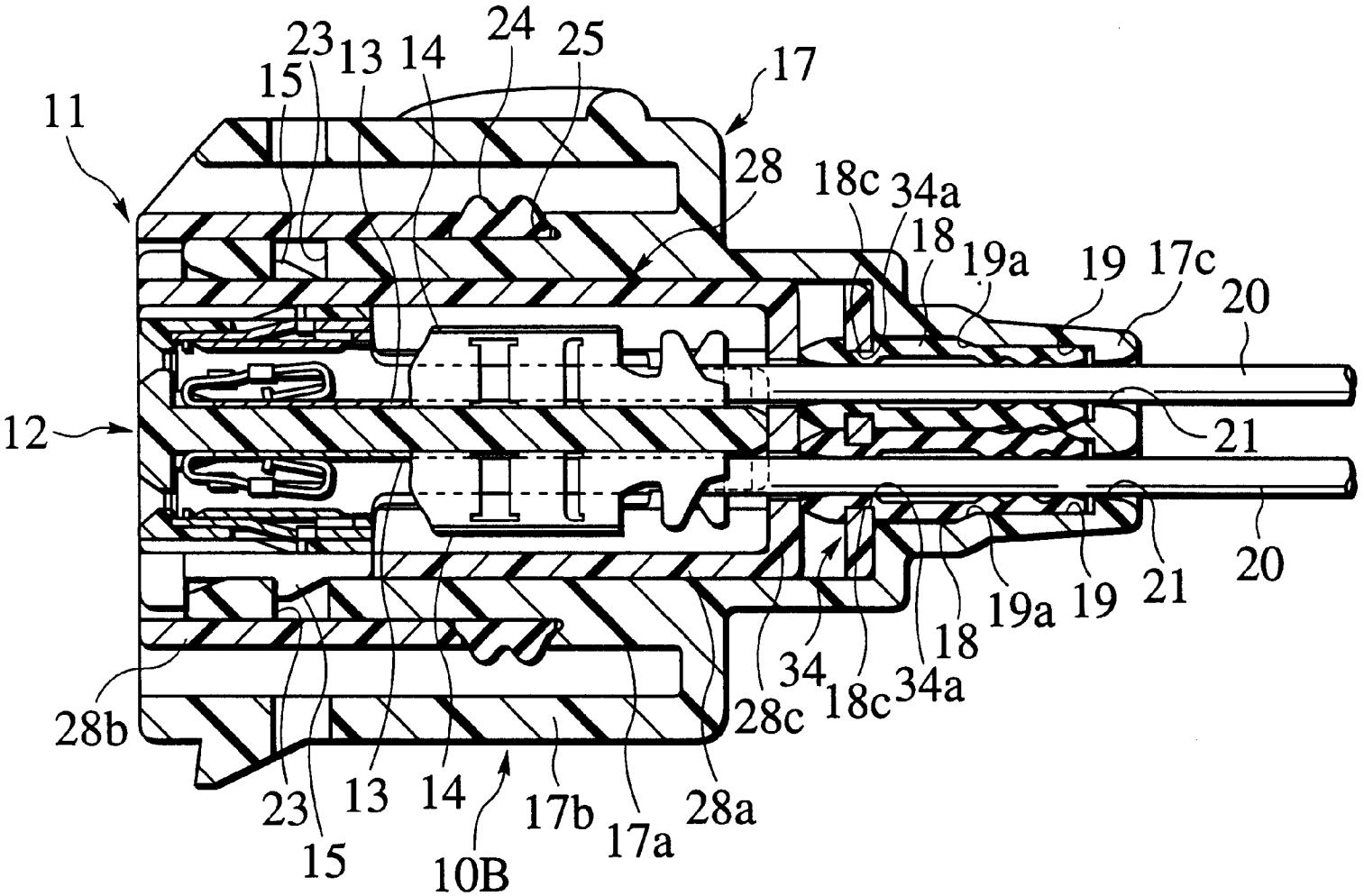
FIG. 7 is a sectional view illustrating a regularly by-engagement kept state where the spacer has been by-engagement kept by the outer housing of the waterproof connector of FIG. 6.

As illustrated in FIGS. 6 and 7, the spacer 28 of a waterproof connector 10B according to a second embodiment has formed therein a plate-like by-engagement-keeping portion 34, or engagement member, whose shape is the same as that of the bottom wall portion 28*c* of the spacer 28. Specifically, the portion 34 is integrally projectively formed (may be so formed separately) on the bottom wall portion (a wall portion) 28*c* side of the spacer 28 at a prescribed distance from this bottom wall portion 28*c*. At the positions, opposing the respective electric wire insertion through holes 33, of the bottom wall portion 28*c* of the spacer 28, there are respectively formed round holes 34*a* whose diameter is greater than the diameter of the respective electric wire insertion through holes 33. With these round holes 34*a* there are engaged recessed portions (by-engagement-keep portions) 18*c* on one end side of the elongate and substantially cylindrical rubber plugs 18 so that these recessed portions 18*c* can be freely drawn off. Also, the respective rubber plug accommodation recesses 19 inside the bottom wall portion (a wall portion) 17*c* of the outer housing 17 are also each made into an elongate configuration. At a midway position on the opening side thereof, there is formed an inverse-conical surface (taper face) 19*a*. It is to be noted that other constructions are the same as those of the waterproof connector 10A according to the first embodiment and therefore an explanation thereof is omitted with the same construction components being denoted by like reference symbols.

The waterproof connector 10B of the second embodiment having the above-described construction exhibits the same functions and effects as those of the waterproof connector 10A of the preceding embodiment. In addition, when restoring the spacer 28 from its regularly kept state illustrated in FIG. 7, where it is regularly kept in the inner wall portion 17*a* of the outer housing 17 to its provisionally kept state illustrated in FIG. 6 of its being provisionally kept therein, the rubber plugs 18 can be easily reliably disengaged from their corresponding rubber plug accommodation recesses 19 of the outer housing 17. This makes it easy to perform the operations of disassembling and re-assembling the waterproof connector 10B when performing maintenance and inspection, etc.

Additionally, although according to each of the above-described embodiments an explanation has been given of a case where performing pressure-contact of the electric wires to the pressure-contact terminals, the terminals are not limited to pressure contact terminals. The invention of course permits each of the above-described embodiments to be applied also to a case where performing pressure-fitting of the electric wires to solderless terminals. Also, the contents that are included in Japanese Patent Application Laid-Open Publication No. 10-60096 are incorporated herein by reference.

COMPARATIVE EXAMPLE

Figure 8:
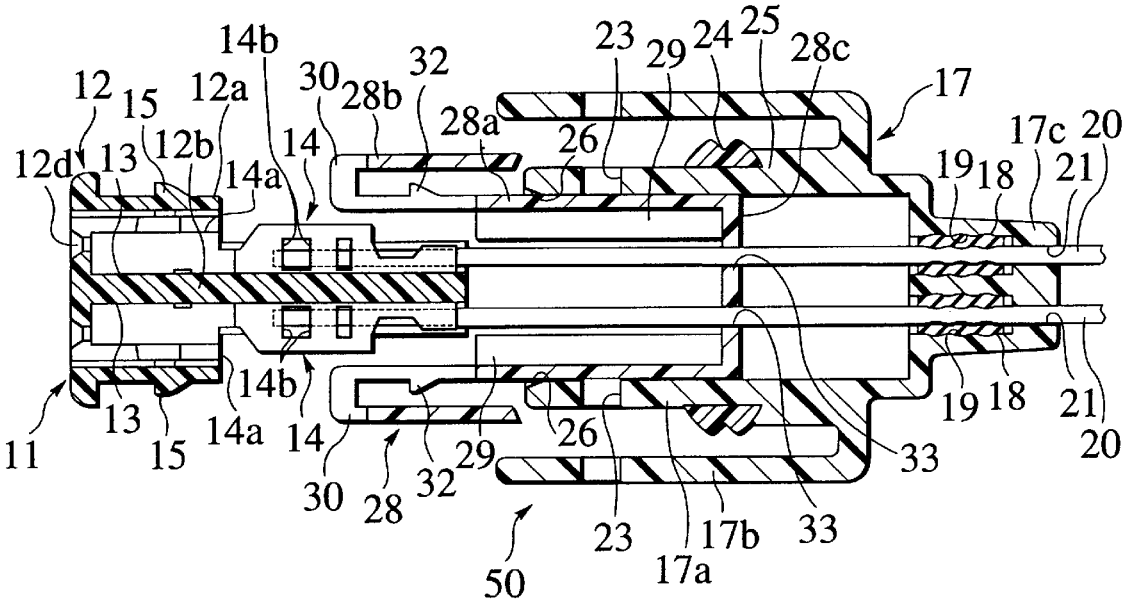
FIG. 8 is a sectional view illustrating a state prior to the assembling of a waterproof connector, which has been prepared as a comparative example.

A waterproof connector 50 of a comparative example differs from the first embodiment in that as illustrated in FIG. 8 no taper faces are formed either on the opening side of the rubber plug accommodation recesses 19 inside the bottom wall portion (a wall portion) 17*c* of the outer housing 17 or on the peripheral surfaces of the respective electric wire insertion through holes 33 on the outer side of the bottom wall portion (a wall portion) 28*c* of the spacer 28. It is to be noted that other constructions are the same as those of the waterproof connector 10A according to the first embodiment and therefore an explanation thereof is omitted with the same construction components being denoted by like reference symbols.

A method of assembling the waterproof connector 50 will now be explained.

Figure 9A:
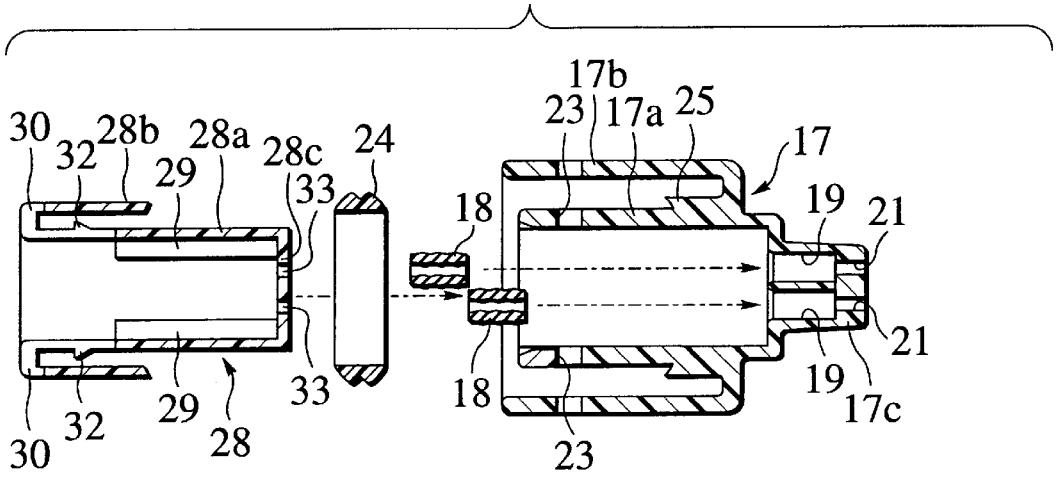
FIG. 9A is a sectional view illustrating a state prior to the assembling of the waterproof connector of FIG. 8.

As illustrated in FIG. 9A, first, the rubber plugs 18 are respectively inserted into, and set in, from the direction in which the connector housing is fitted, their corresponding rubber plug accommodation recesses 19 inside the bottom wall portion 17*c* of the outer housing 17 forming the outer side of the connector housing 11. On the other hand, the packing 24 is inserted into, and set in, the packing receiver 25 of the inner wall portion 17*a* of the outer housing 17.

Figure 9B:
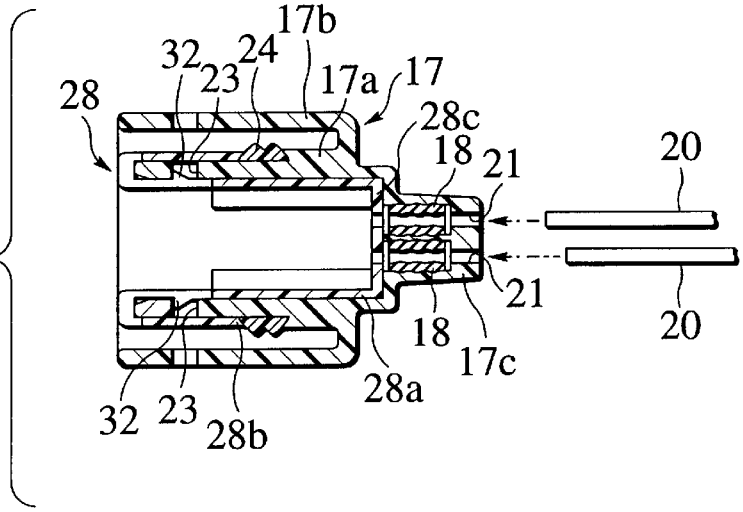
FIG. 9B is a sectional view illustrating a state where a spacer has been fitted into an outer housing of the waterproof connector.

Thereafter, as illustrated in FIG. 9B, the trunk portion 28*a* of the spacer 28 is fitted into the inner wall portion 17*a* of the outer housing 17. The respective engaging pawls 32 of the trunk portion 28*a* of the spacer 28 are engaged with their corresponding engaging holes 23 of the inner wall portion 17*a* of the outer housing 17. By engagement between the respective engaging holes 23 of the inner wall portion 17*a* of the outer housing 17 and the corresponding engaging pawls 32 of the trunk portion 28*a* of the spacer 28, the respective rubber plugs 18 are prevented from being drawn off by the bottom wall portion 17*c* of the outer housing 17. Simultaneously, the packing 24 is prevented from being drawn off by the oblique forward end of the collar portion 28*b* of the spacer 28. Thus, it is possible to enhance the waterproofness of the entire connector housing to a level that is one step higher.

Figure 9C:
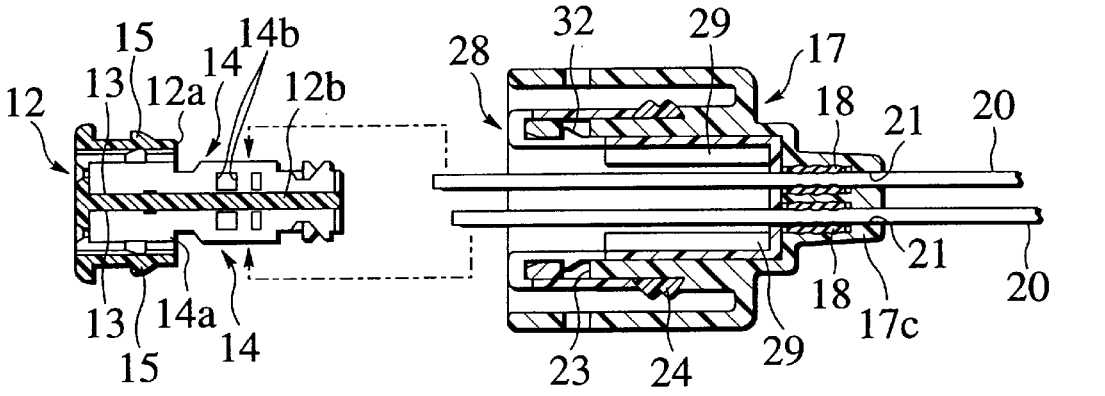
FIG. 9C is a sectional view illustrating a state where electric wires have been passed through the outer housing and spacer.
Figure 9D:
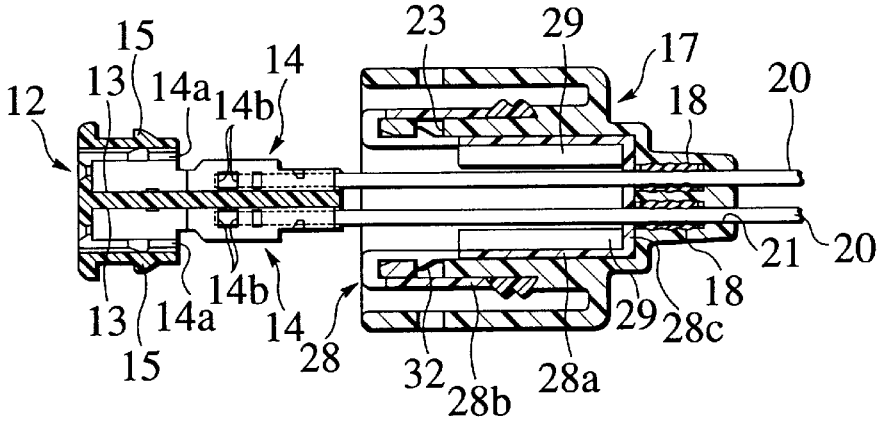
FIG. 9D is a sectional view illustrating a state where the electric wires have been connected to the terminals which have been accommodated in their respective terminal accommodation chambers of an inner housing.

Next, as illustrated in FIG. 9C, the electric wires 20 are respectively passed, from the respective electric wire insertion through holes 21 of the bottom wall portion 17*c* of the outer housing 17, through the respective electric wire insertion through holes 33 of the respective rubber plugs 18 and bottom portion 28*c* of the spacer 28, from the outside. Next, as illustrated in FIG. 9D, the respective electric wires 20 are pressure contacted to their corresponding pairs of pressure contact blades 14*b* of the female terminals 14 accommodated in the terminal accommodation chambers 13 of the inner housing forming the inner side of the connector housing 11.

Figure 9E:
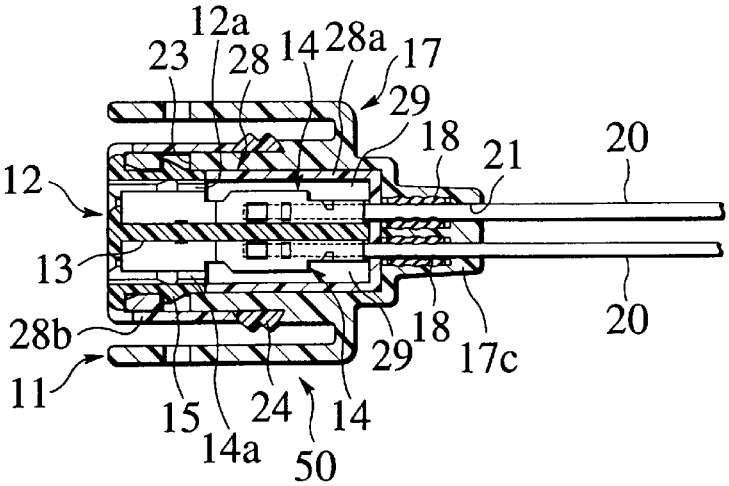
FIG. 9E is a sectional view illustrating a state where the assembling of the waterproof connector has been completed.

Next, as illustrated in FIG. 9E, the inner housing 12 is fitted into the trunk portion 28*a* of the spacer 28. The respective engaging pawls 15 of the box portion 12*a* of the inner housing 12 are by-engagement kept by their corresponding engaging holes 23 of the inner wall portion 17*a* of the outer housing 17. The assembling of the waterproof connector 50 is thus completed.

At this time, the rear end edge of the box portion 12*a* of the inner housing 12 and the rear end edges of the box portions 14*a* of the female terminals 14 accommodated in the terminal accommodation chambers 13 are respectively locked by their corresponding projections 29 that have protruded from the inner surfaces of the upper and lower walls of the trunk portion 28*a* of the spacer 28. In addition, it does not happen that the respectively projections 29 are deformed to the outer side. Therefore, the female terminals 14 are reliably prevented from falling away from their corresponding terminal accommodation chambers 13. Furthermore, since the engagement of the respective female terminals 14 and the engagement of the respective rubber plugs 18 can be simultaneously maintained by the spacer 28, no single-purpose parts for preventing the draw-off of the rubber plugs are needed. This makes it possible to reduce the number of the constituent parts employed and thereby to reduce the cost involved. Further, the spacer 28 is doubly locked by the engagement of the respective engaging pawls 32 of the spacer 28 itself with their corresponding engaging holes 23 of the outer housing 17 and the engagement of the respective engaging pawls 15 of the inner housing 12 with their corresponding engaging holes 23 of the outer housing 17. Therefore, the respective rubber plugs 18 and packing 24 can be reliably prevented from falling away from their regular positions. Thus, it is possible to enhance the reliability on the waterproofness again.

Figure 10:
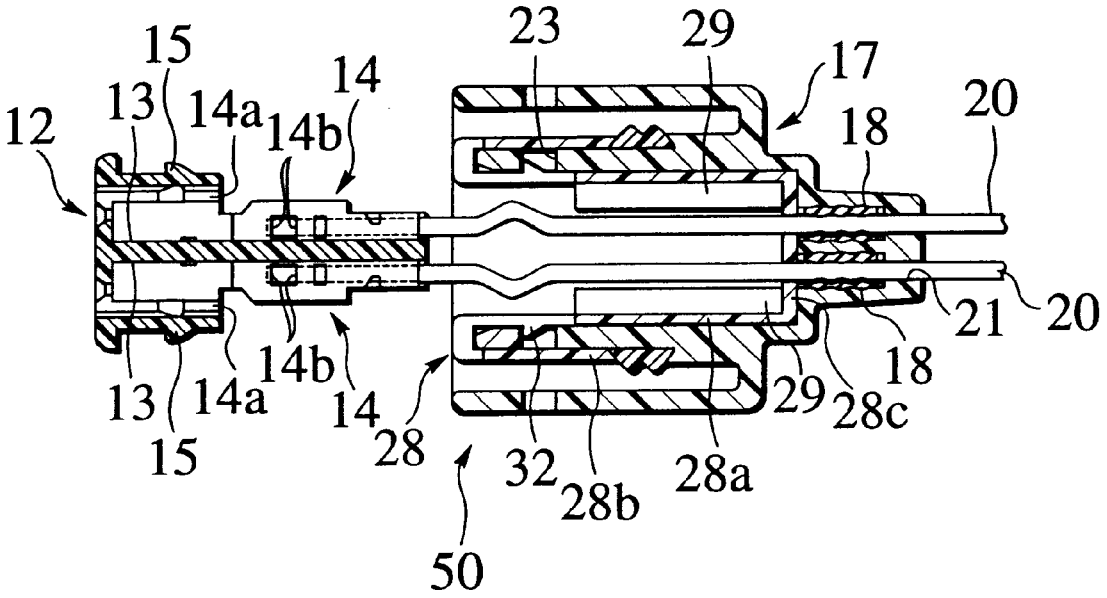
FIG. 10 is a sectional view illustrating a state before the inner housing of the waterproof connector of FIG. 8 is fitted into the spacer that has been fitted into the interior of the outer housing.

On the other hand, as illustrated in FIG. 10, in the above-described waterproof connector 50, in a case where the inner housing 12 is fitted into the outer housing 17 side, the following inconveniences occur. Namely, since the rubber plugs 18 are previously accommodated in the rubber plug accommodation recesses 19 of the outer housing 17, when fitting the inner housing 12 into the spacer 28 that has been fitted in the outer housing 17 while sliding the electric wires 20 with respect to their corresponding electric wire insertion through holes 33, 21 of the spacer 28 and outer housing 17, the rubber plugs 18 apply their pressing force to the electric wires 20. As a result, the electric wires 20 become liable to be buckled due to the resulting frictional force, with the result that the efficiency of the assembling operation of the waterproof connector 50 becomes inferior.

What is claimed is:

1. An assembling method of a waterproof connector having a terminal connected to an electric wire accommodated in a connector housing such that the terminal and the electric wire is sealed by an elastic plug, comprising the steps of:

passing an electric wire through a first housing, the elastic plug and a spacer;

fitting the spacer in a first housing such that the elastic plug is in a first position adjacent to a plug accommodation portion of the first housing;

connecting the electric wire while the terminal is in a second housing;

fitting the second housing inside the spacer; and pressing the spacer inside the first housing so as to move the elastic plug from the first position to a second position inside the plug accommodation portion of the first housing.

2. A waterproof connector having a terminal connected to an electric wire accommodated in a connector housing sealed by an elastic plug, comprising:

a first housing having a plug accommodation portion and configured for receiving the electric wire being passed therethrough;

a spacer fitted in the first housing and configured for receiving the electric wire being passed therethrough;

a second housing fitted in the spacer and configured for accommodating the terminal and receiving the electric wire being passed therethrough;

an elastic plug accommodated in the plug accommodation portion of the first housing and configured for receiving the electric wire being passed therethrough; and a tapered positioning portion arranged between the first housing and the spacer and configured for supporting the elastic plug in a first position where the elastic plug is aligned with the plug accommodation portion of the first housing, before the elastic plug is moved from the first position to a second position inside the plug accommodation portion.

3. A waterproof connector according to claim 2, wherein said tapered positioning portion comprises a front tapered portion provided on an opening side of said plug accommodation portion in said first housing and configured for supporting a front conical surface of the elastic plug before the elastic plug is accommodated inside the plug accommodation portion.

4. A waterproof connector having a terminal connected to an electric wire accommodated in a connector housing such that the terminal and the electric wire is sealed by an elastic plug, comprising:

a first housing having a plug accommodation portion and configured for receiving the electric wire being passed therethrough;

a spacer fitted in the first housing and configured for receiving the electric wire being passed therethrough;

a second housing fitted in the spacer and configured for accommodating the terminal and receiving the electric wire being passed therethrough;

an elastic plug accommodated in the plug accommodation portion of the first housing and configured for receiving the electric wire being passed therethrough;

positioning means to arrange the elastic plug between the first housing and the spacer so as to be aligned with the plug accommodation portion of the first housing, before the elastic plug is accommodated in the plug accommodation portion; and wherein said positioning means comprises a first taper portion and a second taper portion provided on said spacer so as to oppose said plug accommodation portion.

5. A waterproof connector having a terminal connected to an electric wire accommodated in a connector housing such that the terminal and the electric wire is sealed by an elastic plug, comprising:

a first housing having a plug accommodation portion and configured for receiving the electric wire being passed therethrough;

a spacer fitted in the first housing and configured for receiving the electric wire being passed therethrough;

a second housing fitted in the spacer and configured for accommodating the terminal and receiving the electric wire being passed therethrough;

an elastic plug accommodated in the plug accommodation portion of the first housing and configured for receiving the electric wire being passed therethrough;

positioning means to arrange the elastic plug between the first housing and the spacer so as to be aligned with the plug accommodation portion of the first housing, before the elastic plug is accommodated in the plug accommodation portion; and wherein said positioning means comprises an engagement member configured for engaging said elastic plug while being slid into said first housing.

6. A waterproof connector having a terminal connected to an electric wire accommodated in a connector housing such that the terminal and the electric wire is sealed by an elastic plug, comprising:

a first housing having a plug accommodation portion and configured for receiving the electric wire being passed therethrough;

a spacer fitted in the first housing and configured for receiving the electric wire being passed therethrough;

a second housing fitted in the spacer and configured for accommodating the terminal and receiving the electric wire being passed therethrough;

an elastic plug accommodated in the plug accommodation portion of the first housing and configured for receiving the electric wire being passed therethrough, wherein a first tapered portion is formed on an opening side of said plug accommodation portion in said first housing, a second tapered portion is formed on said spacer and is opposed to said plug accommodation portion such that said elastic plug is supported in a first position interposed between said first tapered portion and said second tapered portion, before said elastic plug is moved from the first position to a second position inside said plug accommodation portion.

7. A waterproof connector according to claim 6, wherein said elastic plug has an inside diameter equal to or greater than a diameter of said electric wire, and an outside diameter greater than a diameter of said plug accommodation portion of the first housing.

8. A waterproof connector according to claim 3, wherein said front tapered portion is configured for supporting a front conical surface of the elastic plug before the elastic plug is moved into the plug accommodation portion.

9. A waterproof connector according to claim 2, wherein said tapered positioning portion comprises a rear tapered portion provided on said spacer so as to oppose said plug accommodation portion.

10. A waterproof connector according to claim 9, wherein said rear tapered portion is configured for supporting a rear conical surface of the elastic plug before the elastic plug is pressed into the plug accommodation portion.

* * * * *

UNITED STATES PATENT AND TRADEMARK OFFICE

CERTIFICATE OF CORRECTION

PATENT NO. : 6,196,872,B1
DATED : March 6, 2001
INVENTOR(S) : Takao Murakami et al.

It is certified that error appears in the above-identified patent and that said Letters Patent is hereby corrected as shown below:

Title page,
Item [54], line 2, "ASSEMBLING OF" should read – OF ASSEMBLING --.

Column 10,
Line 50, after "connector housing", insert – such that the terminal and the electric wire is --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*